US005201100A

United States Patent [19]

Cardinale

[11] Patent Number: 5,201,100

[45] Date of Patent: Apr. 13, 1993

[54] ADJUSTABLE DEVICE FOR HOOK AND LOOP FASTENER

[75] Inventor: Emanuel Cardinale, Amherst, N.H.

[73] Assignee: Velcro Industries B.V., Amsterdam, Netherlands

[21] Appl. No.: 898,501

[22] Filed: Jun. 15, 1992

[51] Int. Cl.[5] ..... B65D 63/00

[52] U.S. Cl. ..... 24/306; 24/16 R; 24/194; 24/200

[58] Field of Search ..... 24/306, 307, 442, 17 AP, 24/16 R, 197, 194, 200; 2/DIG. 6; 128/DIG. 15

[56] References Cited

U.S. PATENT DOCUMENTS

| | | | |
|---|---|---|---|
| 711,798 | 10/1902 | Taylor | 24/200 |
| 1,256,822 | 2/1918 | O'Malley et al. | 24/307 |
| 2,107,517 | 2/1938 | Bishop | 24/194 |
| 3,000,384 | 1/1960 | Piers, Jr. | 132/46 |
| 3,267,542 | 8/1966 | Sussman | 24/194 |
| 3,336,639 | 8/1967 | Rutty et al. | 24/200 |
| 3,372,438 | 11/1967 | Rinecker | 24/16 |
| 3,414,943 | 12/1968 | Hattori | 24/200 |
| 3,426,363 | 2/1969 | Girard | 2/338 |
| 3,679,530 | 6/1970 | Perina | 161/43 |
| 4,005,506 | 2/1977 | Moore | 24/16 R |
| 4,149,540 | 4/1979 | Hasslinger | 24/16 R |
| 4,528,700 | 7/1985 | Johnson | 2/DIG. 6 |
| 4,854,015 | 8/1989 | Shaull | 24/16 |
| 5,075,933 | 12/1991 | Kemper | 24/306 |
| 5,121,865 | 6/1992 | Howard | 24/306 |

*Primary Examiner*—Victor N. Sakran

*Attorney, Agent, or Firm*—Hayes, Soloway, Hennessey & Hage

[57] ABSTRACT

A strap of extended length having a surface of either hook or loop elements forming part of a hook and loop fastener system is combined with a D-ring. The D-ring has a first tab, extending from one side thereof and has on one surface of the tab a multiplicity of engaging elements for engaging companion hook or loop elements on said strap. A second tab extends from the opposite side of the D-ring and has means for attaching the D-ring to another object.

9 Claims, 4 Drawing Sheets

PRIOR ART

ADJUSTABLE DEVICE FOR HOOK AND LOOP FASTENER

BACKGROUND OF THE INVENTION

This invention relates to a strap from a hook and loop fastener and more particularly to a D-ring for such a hook and loop strap which simplifies the construction and use of such strap.

It is well known in the art to use hook and loop fasteners in configurations which include a D-ring. Such D-rings are used by attaching one end of the fastener strip to the D-ring and manipulating the other end of the strip to form a loop which can surround objects, to hold them, and threading the tip of the strap back through the opening in the D-ring and releasably attaching the tip of the strip to companion elements on the body of the strap. A D-ring, as used herein, is a flat section of material containing an opening, often configured in the shape of a "D", and thus the name, which is used as a cinch ring or a buckle to fasten two loose ends of a belt or strap. Sometimes such devices are called buckles but in this case, I prefer to use the term D-ring. The top view profile of the D-ring may take on many shapes, but the most common is a rectangular shape where two side legs of the D-ring are used to hold two opposite end legs which in turn carry some suspended member such as a belt or strap. Hook and loop straps with D-rings have been long used to secure boxes where the strap surrounding the box holds the flaps in place and prevents them from opening and spilling the contents of the box. U.S. Pat. No. 3,000,384 dated Jan. 4, 1960 illustrates such straps used to encircle and bind a hank of hair. In such products the longitudinally spaced engaging portions may be in face to face proximity or may be in face to back proximity depending upon the specific threading contemplated for the strap. U.S. Pat. No. 3,679,530 to Perina discloses an attachment device for securing to other object comprising hooking elements affixed to a ridged support member and an elastic band also attached to the opposite sides of the support member so as to form a loop which can be fitted around to encircle objects of irregular cross sectional shapes. U.S. Pat. No. 4,149,540 is typical of many patents which teach the use of cinch straps in various combinations with secondary straps through various ring arrangements. All of these combinations conventionally thread a strip fastener around an object and through a D-ring in such a way as to have one portion of the strip, the hooking element for example, engage the face of the other portion of the strip, the loop elements to create a cinching action around the object.

U.S. Pat. No. 4,854,015 to Shaull discloses a flexible loop clamp and strap in which the ridged base member includes a mounting portion for connecting to a support structure and a strap attachment portion to which a strap is intimately attached such that the strap is designed to thread back through an opening in the base member, the strap is threaded back upon itself to engage with opposing mating element on its back side. This patent also teaches one configuration wherein the base member incorporates on one surface opposing mating elements to engage the opposite mating elements on the strap face.

Hook and loop straps are customarily composed of a D-ring attached to one end of a length of a strip containing elements on one side while their companion elements are attached to the other side of the strip. The strap is attached to or surrounds articles by the length of material constituting the strap to form a noose which can be tightened around the article. In such case, there is no need for means of attaching the strap directly to an article. It is also known to affix D-rings to objects and thread a strap assembly through the D-ring and back upon itself to fasten to companion elements making up a portion of the strap. In all such cases, the strap is a complex product requiring fabrication of the different companion elements into a single continuous strap. To my knowledge there has never been available, a stand alone D-ring which incorporates hook or loop elements as a part of the D-ring itself without having a strap as an integral part of the assembly.

Prior art products are complex assemblies which are most often individually fabricated from combinations of hook and loop components specifically selected for the application contemplated. A section of loop has to be attached to a portion of hook to create the basic strap and the strap portion, thus formed, has to be attached to the "D" ring by sonic sealing, sewing or other means to perform its strap function. The process of fabricating strap products, therefore, imposes considerable delay in adopting straps to specific needs in the field. It would be preferable to have a strap configuration that can be easily fabricated in the field as needed. Therefore, it is one objective of the present invention to create a strap, including a "D" ring, which can be easily assembled in the field without the need of complex assembly methods or tools such as sealing machines and the like. It is a further objective of the present invention to provide a strap which is readily adaptable to many different articles. A still further objective of this invention is to provide a "D" ring capable of being attached to a wide range of objects. Still other objectives will become obvious with the following descriptions.

SUMMARY OF THE INVENTION

The present invention is an attachment device for attaching a strap of a hook and loop fastener system to other objects. The strap has hook or loop attaching elements on its surfaces. The attachment device comprises a D-ring having an opening for passing an end of the hook and loop strap; a first tab extending from one side of the D-ring, having at least on one side a multiplicity of engaging elements for engaging companion elements of the strap; a second tab extending from the opposite side of the D-ring having means for attaching to another object. The strap of companion elements of the hook and loop type is attached to the first tab and then can be fitted around an article and then threaded through the opening of the D-ring and attached to the fastener elements on the surface of the first tab to cinch the article to the object to which the second tab is attached.

In this manner the need for complex assembly of a strap is avoided and my proposed device reduces the time and expense of complex assembly of a hook and loop strap. The invention is essentially a stand alone "D" ring which has fastening elements built into it. The "D" rings are fabricated independently of the manufacture of the strap portion. When in the field, one is able to utilize standard hook or loop tape to fabricate a strap on site with little or no effort or special tools. The "D" ring of the instant invention is attached to the first object by suitable means; a hook and loop strip is cut to the necessary length; the strip is wrapped around the second object which is to be attached to the first object; the strap is then threaded back through the opening of the "D" ring and the free end is fastened to the free fastening elements on the first tab. It is the object of this invention to produce a stand alone D-ring device which can be rapidly attached to an object and be in a position to receive a simple length of loop elements attached to another object, or another part of the same object, to cinch the first part with the second part. It is a further object to produce a D-ring which can be rapidly adopted to attach to differing objects or substrates. It is yet another object to develop a strap device without the need for laminating or otherwise joining the companion elements of a hook and loop closure system.

DETAILED DESCRIPTION OF THE INVENTION

Figure 1:
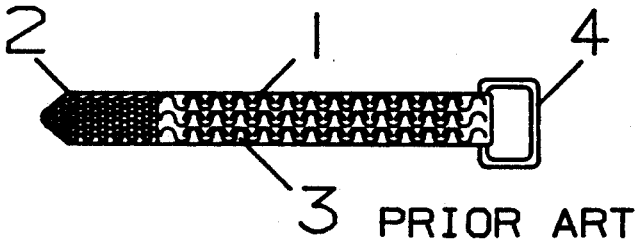
FIG. 1 is a drawing of the traditional hook and loop strap of the prior art known generally as a cinch strap.

Now referring specifically to FIG. 1. A hook and loop strap (1) is made up of a tip portion (2), customarily containing hook elements on its face; a body portion, customarily containing loop elements on its face; and a D-ring (4) fastened to the body portion. A D-ring as used herein is a flat section of material containing an opening, often times configured in the shape of a "D", and thus the name, which is used as a cinch ring or a buckle to fasten two loose ends of a belt or strap. The top view shape of the D-ring may take on many shapes but the most common is a rectangular shape where two side legs of the D-ring are used to hold two opposite end legs which in turn carry some suspended member such as a belt or strap.

Figure 2:
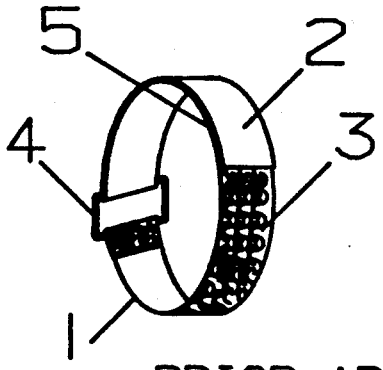
PRIOR ART FIG. 2
FIG. 2 is the strap on FIG. 1 cinched around an object (not shown) and threaded back through a conventional D-ring to close the strap.
Figure 3:
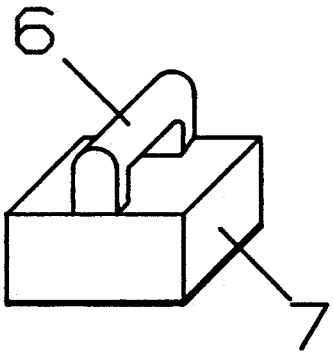
PRIOR ART FIG. 3
FIG. 3 depicts a D-ring built into an object.
Figure 3A:
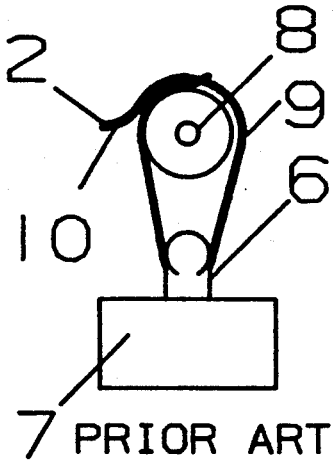
PRIOR ART FIG. 3A
FIG. 3*a* depicts the D-ring of FIG. 3 attached to an object with a conventional strap threaded therethrough to hold two objects together.

The D-rings used commonly with hook and loop fasteners may be fastened to the strap in a variety of ways, but it is customary to thread the end of the tape through the D-ring and turn it back on itself where the turned back section is attached to the body portion by sewing, sealing, gluing or the like. In this manner the D-ring is permanently attached to the hook and loop strap. FIG. 2 illustrates use of a cinch strap thus formed. The strap (1) is used by wrapping it around an object (not shown), threading the tip (2) of the strap (1) back through the D-ring (4) to cause the strap (1) to form a noose which encircles an object to be cinched. The tip (2), containing companion element, hooks for example, is engaged to the elements, loops for example, on the body of the strap. Engaging those elements at their respective faces (5) fastens the two pieces together to form a strong bond capable of withstanding considerable stress. Such straps are well known and have been used for a long period as shown by the prior art. FIG. 3 shows another well known arrangement for using D-rings where the D-ring (6) is fabricated as a part of an object (7). FIG. 3*a* is a cross section view of how two objects, one having a D-ring built into it, would be attached to another object (8). Such a strap is often referred to as a back strap because the hook and loop elements are on opposite sides, or back to back, on the strap. The strap (9), made up of loop is cinched around object (8) and threaded through the D-ring (6) on the first object (7) and back around the second object (8) such that hooks (10), on the inside face of the tip (2), engage with loops on the outside of the body to form a fast bond and hold the two objects together. The disadvantage of such arrangements is that special steps must be made to incorporate the D-ring into the first object which is often inconvenient and expensive. In some cases the presence of the D-ring is on a very inconvenient part of the object and will interfere with its function when used apart from the cinching mode.

Figure 4:
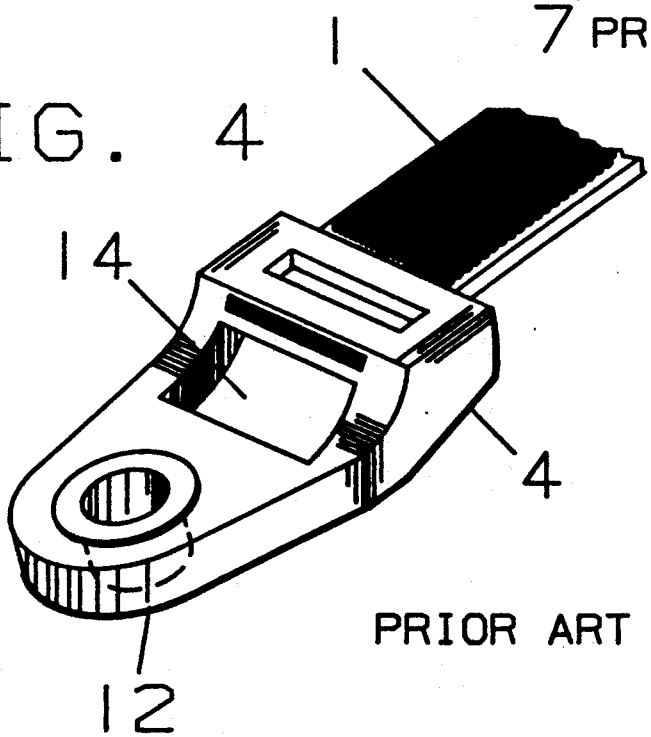
PRIOR ART FIG. 4
FIG. 4 depicts a "D" ring of the prior art showing a strap portion permanently attached to the "D" ring by injection molding the "D" ring to the strap as taught by Shaull.

FIG. 4 illustrates a "D" ring arrangement of the prior art as taught by Shaull where the "D" ring is fabricated around the strap. The shortcoming of this method is the entire strap has to be designed prior to being fabricated which prevents field adaption of a strap to the particular circumstances found at the time the strap is needed. If the circumstances are not exactly as contemplated in the design of the strap little or no flexibility is available to adopt the configuration to the particular job.

Figure 5:
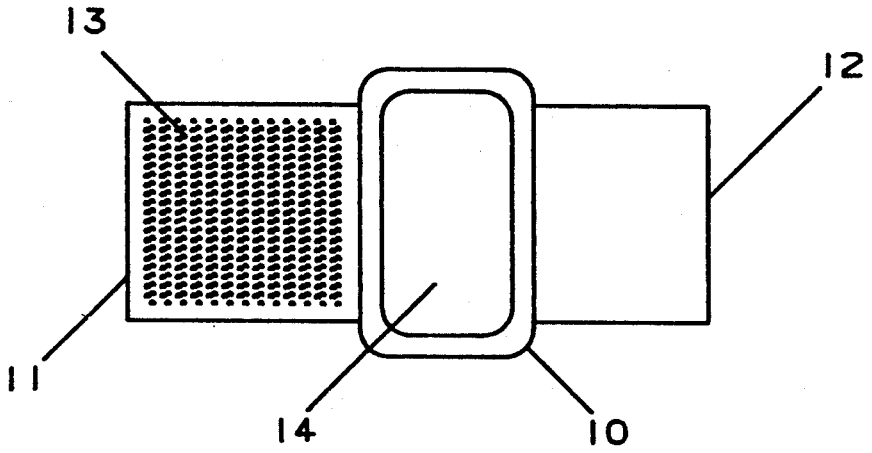
FIG. 5 is a drawing of the D-ring of the instant invention.

FIG. 5 is a top view of the present invention.

Figure 6:
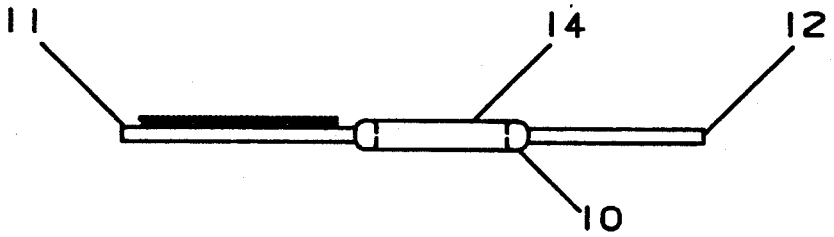
FIG. 6 is a side view of the D-ring of this invention.
Figure 7:
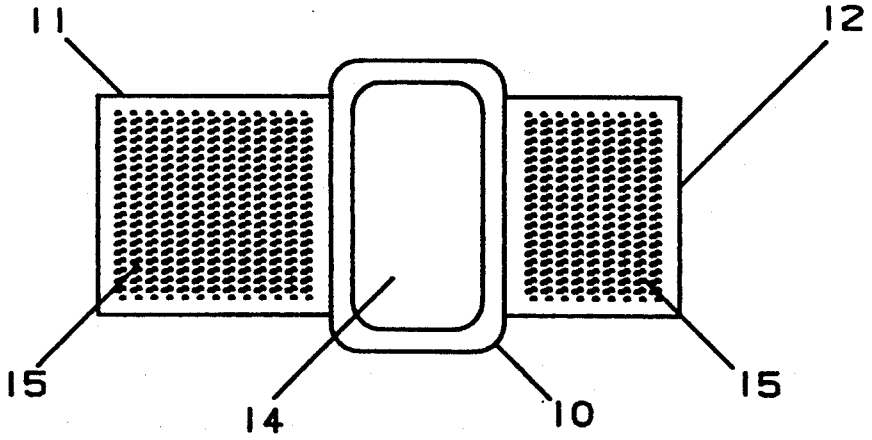
FIG. 7 is another embodiment of the D-ring of this invention.
Figure 8:
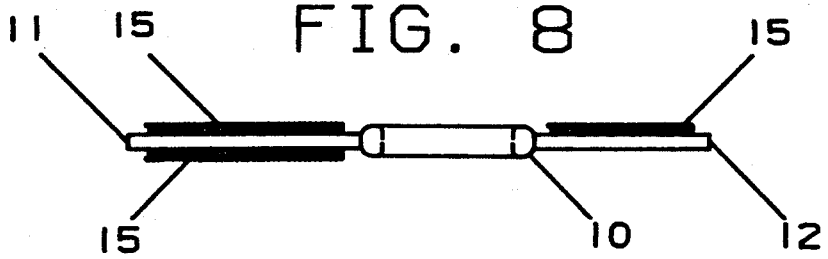
FIG. 8 is a side view of the embodiment of FIG. 7.
Figure 9:
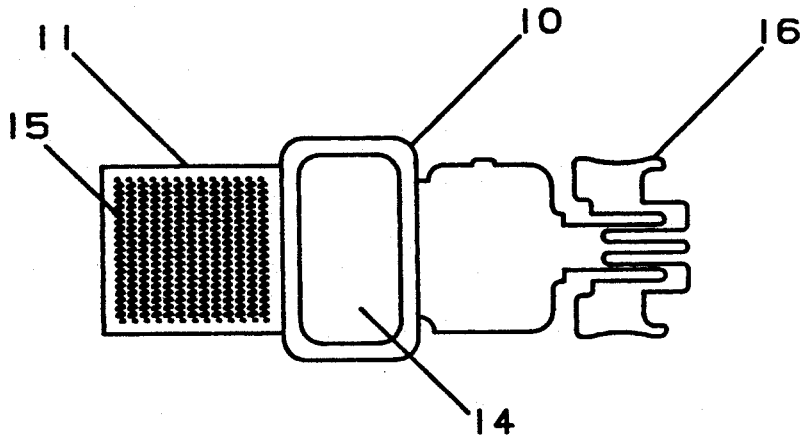
FIG. 9 is still another embodiment of this invention where the first tab is fitted with hooking elements for attaching one side of the D-ring to the object using hook and loop and the other tab of the D-ring is another type of clip fastener for insertion to the receiving element of the clip fastener attached to the object.

FIG. 6 is a cross sectional view of FIG. 5. As can readily be seen, the invention extends the idea of a D-ring to a stand alone entity apart from the strap itself by incorporating tabs into the design of the ring which carry on their surface appropriate fastening elements. D-ring (10) has a tab (11) extending from one outside wall of the D-ring and in the same plane as the D-ring, for any reasonably desired length but generally between one and three inches. On the surface of the tab (11) are fastening elements (13) which can be either hook or loop, but generally, I prefer to use hook in this location as will be made evident below. From the opposite side of the D-ring a second tab (12) projects, also in the plane of the D-ring. This tab is intended for fastening to another object. Any convenient method of attaching device can be utilized. For example, a rivet can be used to attach the D-ring device to an object. The tab can be glued, welded, sewn or otherwise sealed to an object. The second tab can also use fastening elements of the hook and loop type if appropriate in the specific application. FIGS. 7 and 8 show the extended D-ring (10) of the present invention where the tabs (11) and (12) are covered with elements (15) of a hook and loop type. Both sides may have hook or both sides may have loop or one may be loop and the other hook. FIG. 9 shows yet another embodiment of the invention where the first tab (11) contains on both its surface hooking elements (15) and the other tab (16) is a clasp which is intended to fit into the female portion of the clasp designed positioned on the object to be attached. Any desired combination of clasping mechanisms may be used with this configuration.

Figure 10:
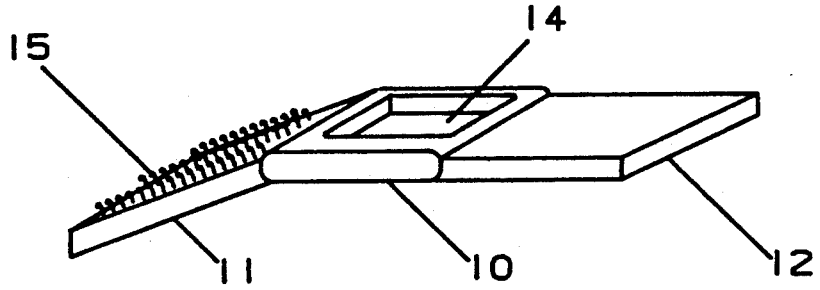
FIG. 10 is a side view of another embodiment of this invention where the first tab is attached to the D-ring along one side of the tab and the plane of the tab is disposed at an obtuse angle from the plane of the top of the D-ring.
Figure 11:
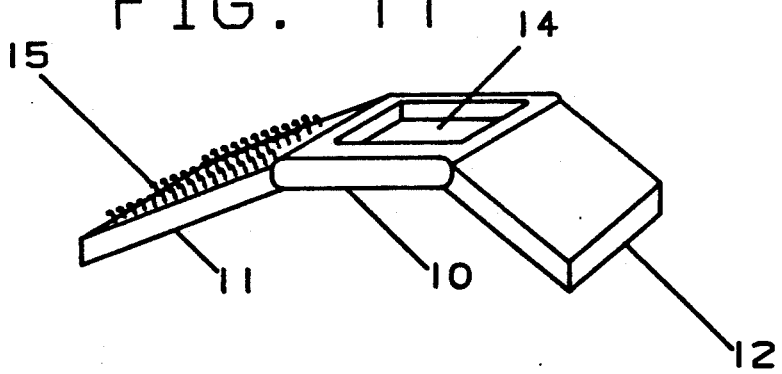
FIG. 11 is a side view of another embodiment of this invention where both the first and second tabs are attached to the D-ring along opposite sides of the D-ring where the plane of both tabs are disposed at an obtuse angle from the plane of the top of the D-ring.
Figure 12:
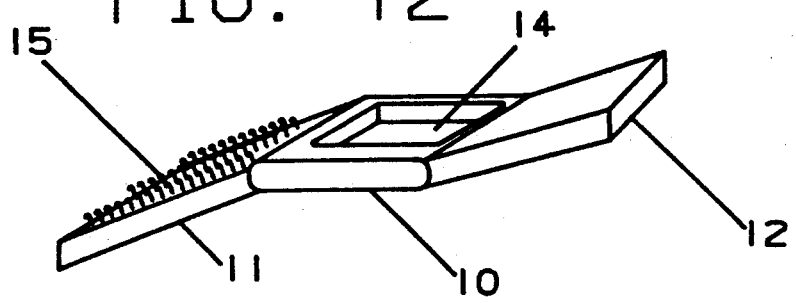
FIG. 12 is a side view of another embodiment of this invention where both the first and second tabs are attached to the D-ring along opposite sides of the D-ring where the plane of the first tab is disposed at an acute angle from the plane of the D-ring and the second tab is disposed at an obtuse angle to the plane of the top of the D-ring.

FIGS. 10 through 12 illustrate various configurations and dispositions of the angle of the tabs. While a very convenient configuration of this device is to have the planes of the tab in the same plane as the plane of the D-ring it is not essential that they in fact reside in the same plane. In some configurations there are advantages to have the plane of the tab set at a different angle than the plane of the D-ring. This can be beneficial where the part needs to fit into a predetermined space or where treading is made more convenient through offsetting the angle of the plane of the tab. In fact, in some cases, disposing the first tab at an angle to the D-ring has the advantage that the engagement of the companion elements is stressed around an angle or a curve which enhances the shear strength of the closure.

Figure 13:
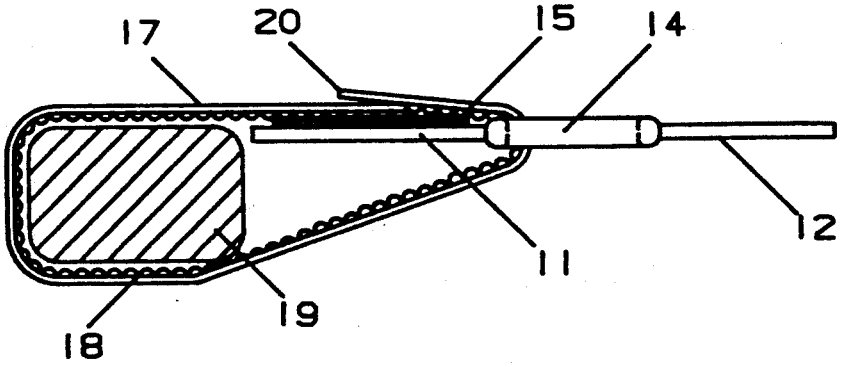
FIG. 13 is a cross sectional view of the device of this invention in use where a strap is holding an article.

FIG. 13 illustrates the device of this invention in use where a length of loop tape (17) having loops (18) is fastened at one end to a section of hooks (15) on tab (11) and then threaded around an article (19) to form a noose around the article. The end (20) of the length of loop (17) is then threaded through the opening (14) in the D-ring and pulled back in the direction of the tab (11) for engagement with hooks (15) disposed on the face of the first tab. In this way, the article is firmly held by the strap of loop. The second tab (12) can then be fastened to an object (not shown) and the article will be tightly bound to the object.

Figure 14:
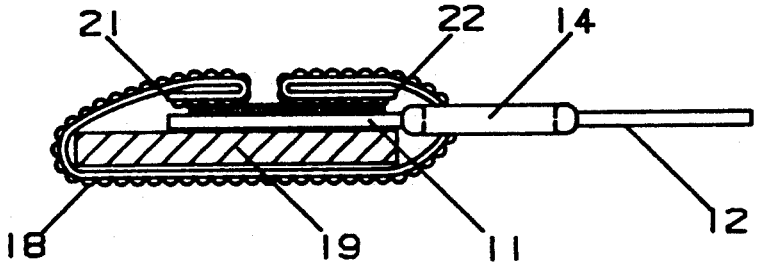
FIG. 14 is yet another view of the device of this invention using alternate threading where a strap with loops on only one surface has its loops disposed away from the article that it is holding and engagement with the hook element on the tab is accomplished by turning back the end of the strap to invert the position of the loops to properly engage the fastening elements on the upper surface of the first tab.

FIG. 14 is identical to FIG. 13 except that the loops (18) are disposed on the surface of the strap away from the article and in order to position the loops (18) to engage with hooks (15) the ends of the strap (17) have been turned back on itself to expose loops to the hooks on the tab.

Figure 15:
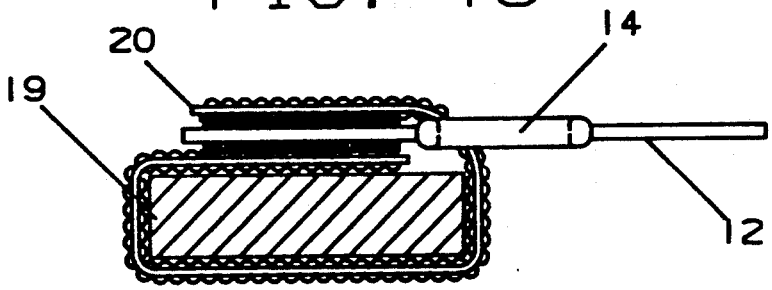
FIG. 15 is another cross-sectional view of the device of this invention in use where a strap, with loops on both front and back faces, is attached to the first tab with hooks on both faces and the strap is holding an article.
Figure 16:
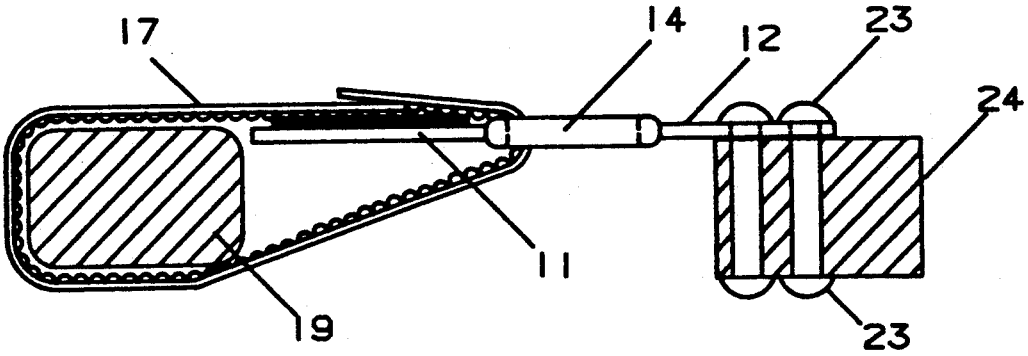
FIG. 16 is a view of any of FIG. 13 wherein the second tab of the device of this invention is attached to a second article and holds the second article tightly to the first article.

FIG. 15 is similar to FIG. 13 but the first tab has hooking elements on both surfaces of the tab and the loop strap also has loops disposed on both surfaces of the strap.

The D-ring of this invention can be made by a variety of methods. One particularly advantageous method is injection molding wherein the mold is designed to produce the entire assembly with one shot of molten plastic. In such case, the mold contains recesses for the tabs and the side arms creating the opening for passing the strap. As plastic flows into the mold, it fills the recesses and crystallizes to form the solid "D"-ring, with its tabs, of the present invention. It is also possible to incorporate into the mold actual hook cavities which create the fastening elements in situ as the "D" ring is being formed, but I prefer to mold the part without the fastening elements included as part of the mold because such molding is complex and requires substantial expense to create the fastener cavities within the mold. Instead, I prefer to attach the hook elements to the tabs after molding by well known methods such as ultrasonic sealing, adhesive bondings, or other conventional fastening means such as riveting. An alternate method of creating the "D" ring of the present invention is machining a block of plastic into the desired shape including flat portions for the tabs to which fastening elements are subsequently added. Another method of creating the "D" ring is assembling individual segments of the "D" ring, such as the two tabs and extended arms, all of which are fastened together to form the "D" ring with its opening for the strap and its respective tabs, as a single part.

The "D" ring of my invention can have a variety of dimensions designed to accommodate the size of strap contemplated or the nature of the cinching job required. One common size, for example, is for use with a one inch wide strap with the most common loop structures similar to a product sold as VELCRO® brand loop 1000. In such case, the "D" ring could have an opening of 1.25 inches wide by 0.25 inches long and thickness of 0.25 inches at the point of the opening. The first tab projects outward two inches from the opening of the "D" ring and the second tab projects one inch from the opening, both tabs resting in a common plane with the plane of the "D" ring. In this example, both tabs contain hook elements on their upper surfaces. In use, the second tab is secured to a section of loop attached to a first object to which a second object is to be attached. A length of the above mentioned loop 1000 is attached to the outer inch of the first tab, threaded around the object to be cinched and back through the opening in the "D" ring and attached to the free hook elements closest to the opening on the face of the first tab. In this way, the second object is securely cinched to the first object.

While the above example is directed to a one inch wide strap, in other cases the object to be cinched may be large requiring a stronger strap and a wider section of loop would be appropriate. For example, the strap might be 2, 3 or even 4 inches wide. It is well known that the holding force of a hook and loop fastening system is proportional to the area of engagement of the hook and loop. In such case, the "D" ring would be fabricated with an opening of width suitable to accommodate the width of the strap. If the weight of the object to be cinched so requires, the attachment areas of the respective tabs can also be enlarged. For example, it is possible to have the first tab any length that will create sufficient engaged area of the fasteners to withstand the forces exerted upon the closure by the weight of the object. Tabs as long as six inches or longer may be appropriate. In the case where the second tab is attached by means such as riveting, the second tab need be very short, perhaps one half inch or less might be appropriate, just sufficient area to accommodate the rivet hole.

The second tab can be arranged as needed to attach to objects either before or after cinching an article. The fastening elements, hooks for example, may be created directly as a part of the molding process, as is well known, or may be insert molded using hook and loop tapes especially adapted for such purpose. Alternately, the fastening elements may be attached to the first tab by well known attaching methods such as gluing, riveting, sealing, ultrasonic welding or the like.

It will be appreciated the flexibility of the system is not limited by the examples described here but can utilize many alternatives depending on the application requirement.

What is claimed is:

1. In combination, a stand alone strap of extended length having a surface of either hook or loop elements forming part of a hook and loop fastener system and a stand alone D-ring having an opening for passing an end of said strap therethrough, said strap being distinct and separate from the assembly of the D-ring, said D-ring having a first tab, extending from one side of the D-ring, which has on at least one surface thereof, a multiplicity of engaging elements for engaging companion hook or loop elements on said strap, and a second tab extending from the opposite side of the D-ring having means for attaching said D-ring to another object, said tabs being much shorter than said strap, whereby when said strap is fitted around an article and threaded through the opening of the D-ring with both ends of the strap attached to the engaging elements on the surface of the first tab it will secure the article to the object to which the second tab is separably attached.

2. The attachment device of claim 1 wherein the first and second tabs are rigid planar members.

3. The attachment device of claim 2 wherein the first and second tabs lay in the principle plane of the D-ring.

4. The attachment device of claim 2 wherein the planar tabs are at one edge fastened to and aligned with the plane of the D-ring and at their opposite ends are displaced from the plane of the D-ring so that the plane of the tabs forms an angle with the plane of the D-ring.

5. The attachment device of claim 4 where the first tab forms an obtuse angle with the top plane of the D-ring and the second tab forms an acute angle with the top plane of the D-ring.

6. The attachment device of claim 1 wherein the first tab contains on its upper surface fastening elements of the hook and loop type.

7. The attachment device of claim 6 wherein the fastening elements are hooks.

8. The attachment device of claim 1 wherein the first tab contains on its upper and lower surfaces fastening elements of the hook and loop type.

9. The attachment device of claim 8 wherein the fastening elements are hooks.

* * * * *